US008636131B2

(12) United States Patent
Kim

(10) Patent No.: US 8,636,131 B2
(45) Date of Patent: Jan. 28, 2014

(54) MEDIUM PROCESS APPARATUS AND FINANCIAL DEVICE

(75) Inventor: Hyun Kim, Seoul (KR)

(73) Assignee: LG CNS Co., Ltd., Seoul (KR)

( * ) Notice: Subject to any disclaimer, the term of this patent is extended or adjusted under 35 U.S.C. 154(b) by 274 days.

(21) Appl. No.: 13/092,301

(22) Filed: Apr. 22, 2011

(65) Prior Publication Data

US 2011/0259708 A1 Oct. 27, 2011

(30) Foreign Application Priority Data

Apr. 23, 2010 (KR) ..... 10-2010-0038001

(51) Int. Cl.
*G07F 7/04* (2006.01)

(52) U.S. Cl.
USPC ..... 194/206

(58) Field of Classification Search
USPC ..... 194/206, 209, 335; 209/534
See application file for complete search history.

(56) References Cited

U.S. PATENT DOCUMENTS 3,930,582 A 1/1976 Gartner et al.
4,781,091 A 11/1988 Nakaya
5,174,562 A * 12/1992 Mizunaga et al. ..... 271/261
6,578,695 B1 * 6/2003 Blaser et al. ..... 194/206
6,672,587 B1 * 1/2004 Mohringer et al. ..... 271/259
8,276,734 B2 * 10/2012 Nago et al. ..... 194/293
2005/0045449 A1 3/2005 Nago et al.

FOREIGN PATENT DOCUMENTS

DE 2423094 A1 12/1974
JP 2003-341920 A 12/2003
KR 10-2006-0051238 A 5/2006

OTHER PUBLICATIONS

Office Action dated Jun. 18, 2012 in German Application No. 10 2011 007 858.4, filed Apr. 21, 2011.
Office Action dated Aug. 21, 2013 in Chinese Application No. 201110103420.9, filed Apr. 25, 2011.

* cited by examiner

*Primary Examiner* — Mark Beauchaine
(74) *Attorney, Agent, or Firm* — Saliwanchik, Lloyd & Eisenschenk

(57) ABSTRACT

Provided is a medium process apparatus. The medium process apparatus comprises a support device configured to support a medium that is being transferred, and a plurality of detecting units configured to detect a state of the medium. The plurality of detecting units are arranged at regular intervals, and each of the plurality of detecting units comprises a detecting lever and a detecting sensor configured to output a signal according to a movement of the detecting lever. If the medium is divided into uniform regions arranged in a direction perpendicular to a transfer direction of the medium, the detecting units detect states of corresponding regions of the medium.

13 Claims, 7 Drawing Sheets

MEDIUM PROCESS APPARATUS AND FINANCIAL DEVICE

CROSS-REFERENCE TO RELATED APPLICATION

The present application claims the benefit under 35 U.S.C. §119 to Korean Patent Application No. 10-2010-0038001, filed on Apr. 23, 2010, which is hereby incorporated by reference in its entirety.

BACKGROUND OF THE INVENTION

The present disclosure relates to a medium process apparatus and a financial device.

Clients can carry out their financial activities using financial devices. For example, deposit, withdrawal, or automatic transfer of media such as money is possible through a financial device. Such a financial device may include a medium process apparatus.

The medium process apparatus may check a state of a medium. For example, the medium process apparatus may detect the thickness of a medium.

BRIEF SUMMARY

Embodiments provide a medium process apparatus and a financial device configured to precisely detect a state of a medium and exactly determine whether the medium is genuine.

In one embodiment, a medium process apparatus comprises: a support device configured to support a medium that is being transferred; and a plurality of detecting units configured to detect a state of the medium, wherein the plurality of detecting units are arranged at regular intervals, and each of the plurality of detecting units comprises a detecting lever and a detecting sensor configured to output a signal according to a movement of the detecting lever, wherein if the medium is divided into uniform regions arranged in a direction perpendicular to a transfer direction of the medium, the detecting units detect states of corresponding regions of the medium.

In another embodiment, a medium process apparatus comprises: a support device comprising a plurality of rollers to support a medium that is being transferred; and a plurality of detecting unit configured to detect a state of the medium, wherein the number of the plurality of detecting units is equal to the number of the plurality of the rollers, the plurality of detecting units are arranged at regular intervals, and the plurality of detecting units comprise detecting levers, detecting sensors configured to output signals according to movements of the detecting levers, and a lever shaft inserted through the detecting levers.

In further another embodiment, a financial device comprises: a transfer path along which a medium is transferred; and a medium process apparatus configured to detect states of a plurality of regions of the medium, wherein the medium process apparatus comprises: a plurality of rollers configured to transfer the medium; and a plurality of detecting units disposed at positions corresponding to the plurality of rollers, wherein the plurality of detecting units comprise a first detecting unit, a second detecting unit, and at least one third detecting units between the first and second detecting units.

The details of one or more embodiments are set forth in the accompanying drawings and the description below. Other features will be apparent from the description and drawings, and from the claims.

DETAILED DESCRIPTION

Figure 1:
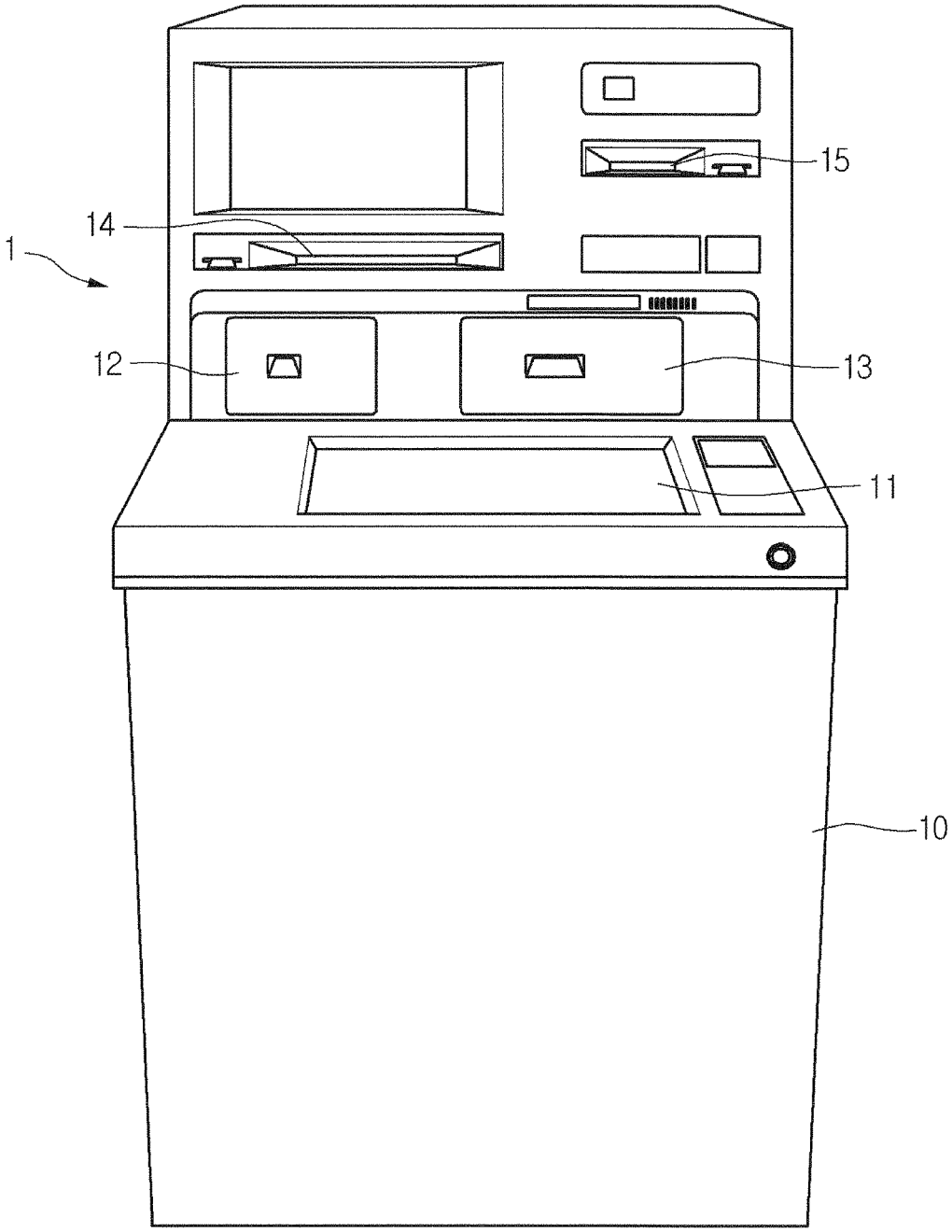
FIG. 1 is a perspective view illustrating a financial device according to an embodiment.

Hereinafter, exemplary embodiments of the present disclosure will be described with reference to the accompanying drawings. Regarding the reference numerals assigned to the elements in the drawings, it should be noted that the same elements will be designated by the same reference numerals, wherever possible, even though they are shown in different drawings. Also, in the description of embodiments, detailed description of well-known related structures or functions will be omitted when it is deemed that such description will cause ambiguous interpretation of the present disclosure.

Also, in the description of embodiments, terms such as first, second, A, B, (a), (b) or the like may be used herein when describing components of the present invention. Each of these terminologies is not used to define an essence, order or sequence of a corresponding component but used merely to distinguish the corresponding component from other component(s). It should be noted that if it is described in the specification that one component is "connected," "coupled" or "joined" to another component, the former may be directly "connected," "coupled," and "joined" to the latter or "connected", "coupled", and "joined" to the latter via another component.

A financial device according to embodiments is a device that performs financial businesses, i.e., medium processing comprising processing such as deposit processing, giro receipt, or gift certificate exchange and/or processing such as withdrawal processing, giro dispensing, or gift certificate dispensing by receiving various media such as, e.g., paper moneys, bills, giros, coins, gift certificates, etc. For example, the financial device may comprise an automatic teller machine (ATM) such as a cash dispenser (CD) or a cash recycling device. However, the financial device is not limited to the above-described examples. For example, the financial device may be a device for automatically performing the financial businesses such as a financial information system (FIS).

Hereinafter, assuming that the financial device is the ATM, an embodiment will be described. However, this assumption is merely for convenience of description, and technical idea of the present disclosure is not limited to the ATM.

Figure 2:
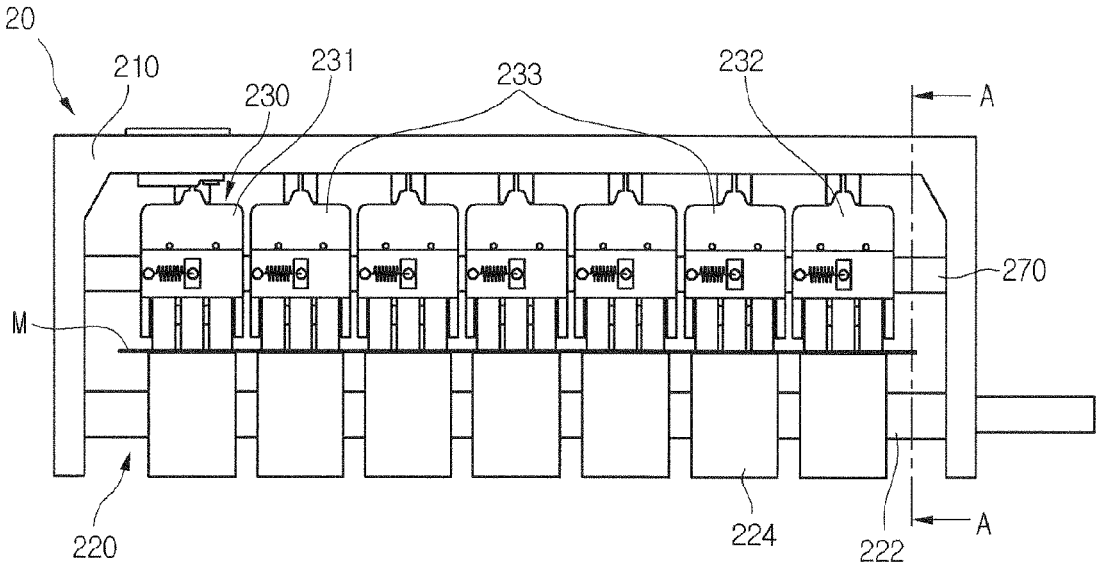
FIG. 2 is a front view illustrating a medium process apparatus according to an embodiment.

FIG. 1 is a perspective view illustrating a financial device 1 according to an embodiment, and FIG. 2 is a front view illustrating a medium process apparatus according to an embodiment.

Referring to FIGS. 1 and 2, the medium process apparatus 20 of the embodiment may be provided in the financial device 1. However, the medium process apparatus 20 may be independently disposed at another place where media (M) are handled.

The financial device 1 comprises a main body 10 in which the medium process apparatus 20 is disposed for detecting a state of a medium (M). The main body 10 may comprise an input unit 11 through which a client can carry out his/her financial activities, a check inlet/outlet 12, a bill inlet/outlet 13, a bankbook inlet/outlet 14, and a card inlet/outlet 15. The financial device 1 may have the same structure as that of a financial device of the related art, and thus a detailed description thereof will be omitted. In the current embodiment, at least one of the bill inlet/outlet 13, the bankbook inlet/outlet 14, and the card inlet/outlet 15 may be omitted. In the present disclosure, inlet/outlets such as the check inlet/outlet 12 and the bill inlet/outlet 13 will be collectively referred to as a medium inlet/outlet.

In the case where the medium process apparatus 20 is provided in the financial device 1, the medium process apparatus 20 may be used to detect counterfeit checks or bills. The financial device 1 may comprise a plurality of medium process apparatuses 20 to detect the thicknesses of checks and bills. Alternatively, the financial device 1 may comprise only one medium process apparatus 20 to detect the thicknesses of checks and bills.

Hereinafter, the medium process apparatus 20 of the embodiment will be described in detail.

Figure 3:
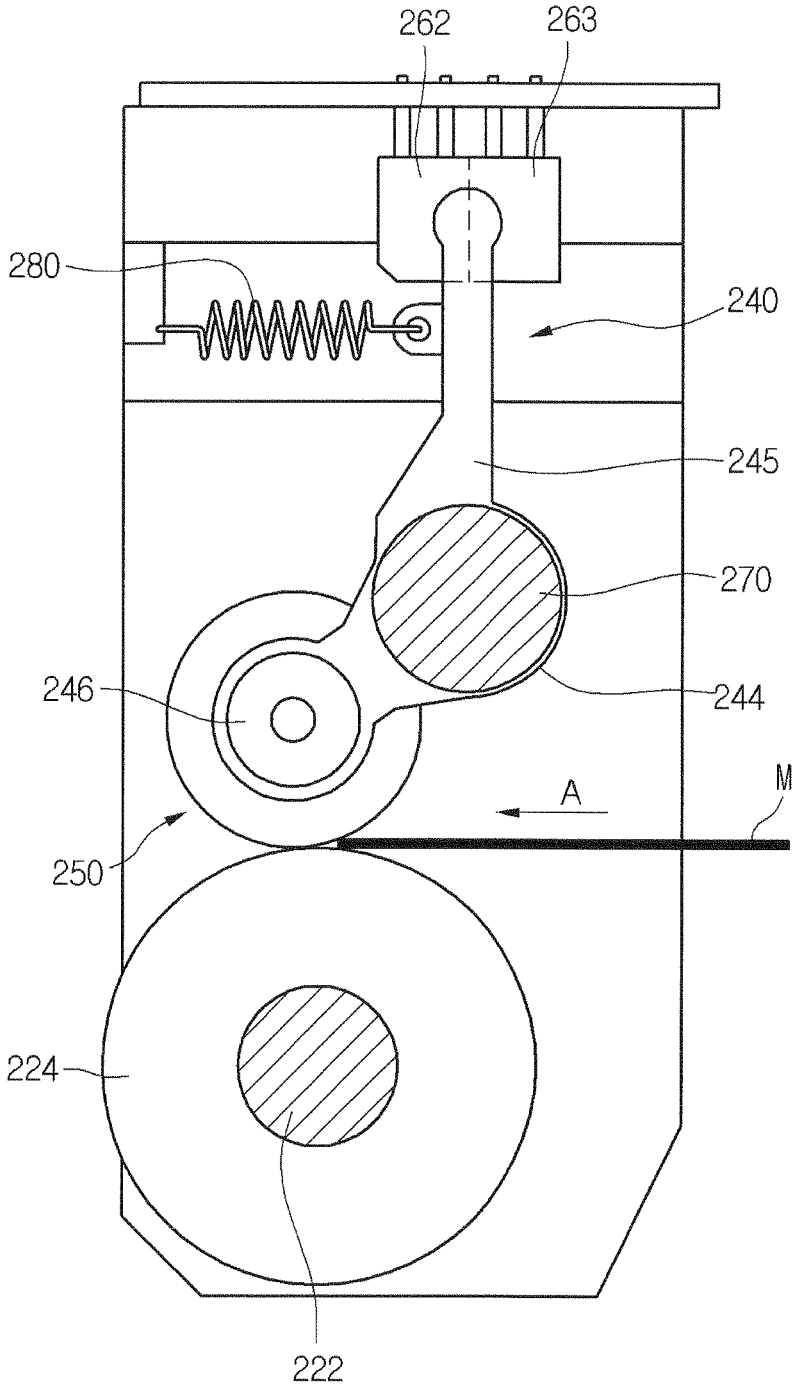
FIG. 3 is a sectional view taken along line A-A of FIG. 2.
Figure 4:
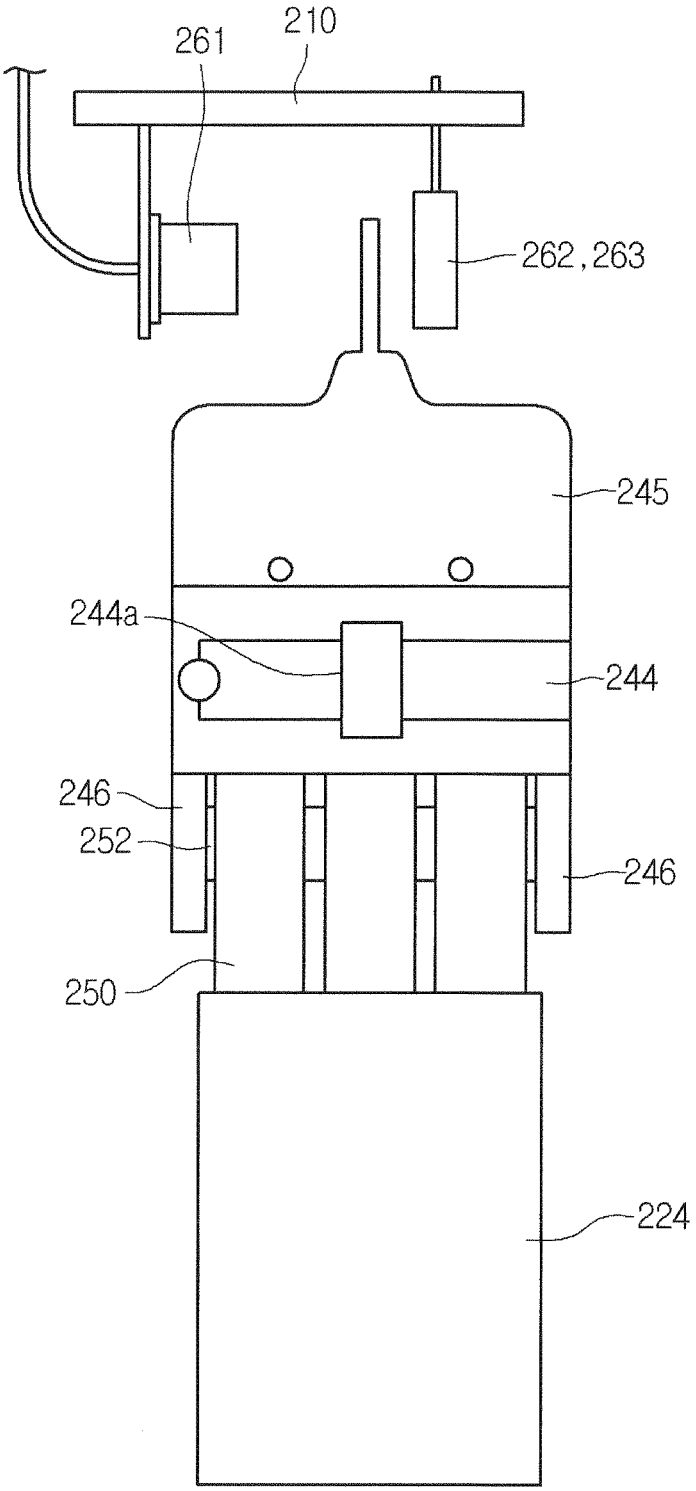
FIG. 4 is a view illustrating a positional relationship between a detecting lever and detecting sensors according to an embodiment.

FIG. 3 is a sectional view taken along line A-A of FIG. 2, and FIG. 4 is a view illustrating a positional relationship between a detecting lever and detecting sensors according to an embodiment.

Referring to FIGS. 2 to 4, the medium process apparatus 20 can detect a state of a medium (M) while the medium (M) is carried along a transfer path. The medium process apparatus 20 comprises a support device 220 configured to support a medium (M) while the medium (M) is transferred, and a plurality of detecting units 230 configured to detect a state of the medium (M) (hereinafter, an explanation will be given of the case where the state of the medium (M) is the thickness of the medium (M)).

In detail, the support device 220 may be disposed on a frame 210 fixed to the main body 10. The support device 220 comprises a roller shaft 222 coupled to the frame 210, and a plurality of first rollers 224 rotatably coupled to the roller shaft 222. The first rollers 224 are arranged at regular intervals. The first rollers 224 support a medium (M) so that the medium (M) can be smoothly transferred.

The detecting units 230 may detect the thickness of the medium (M) over the entire region of the medium (M). Each of the detecting units 230 comprises a detecting lever 240 disposed at an upper side of the support device 220, detecting sensors 261, 262, and 263 configured to detect a movement of the detecting lever 240, and an elastic member 280 elastically support the detecting lever 240. A lever shaft 270 is inserted through the detecting levers 240 of the detecting units 230. That is, the detecting levers 240 may be rotated with respect to the lever shaft 270. At this time, each of the detecting levers 240 may be rotated by friction with a medium (M) which is transferred. The detecting levers 240 may be independently rotated. Therefore, the thickness of a medium (M) may be measured independently by the detecting units 230.

In terms of positions, the detecting units 230 may comprise a first detecting unit 231, a second detecting unit 232, and third detecting units 233. One or more third detection units 233 may be provided between the first detecting unit 231 and the second detecting unit 232. In the embodiment shown in FIG. 2, a plurality of third detecting units 233 are disposed between the first detecting unit 231 and the second detecting unit 232.

The number of the detecting levers 240 may be equal to the number of the first rollers 224. The detecting levers 240 may be spaced at regular intervals. Referring to FIG. 2, the gap between two neighboring detecting levers 240 is smaller than the transversal width of each of the detecting levers 240.

In the current embodiment, the detecting units 230 may detect the thickness of a medium (M) over the entire region of the medium (M). For example, the first detecting unit 231 may be disposed close to an edge of the medium (M), the second detecting unit 232 may be disposed close to the other edge of the medium (M), and the third detecting unit 233 may be disposed between the first and second detecting units 231 and 232.

Each of the detecting levers 240 of the detecting units 230 comprises a body 244 through which the lever shaft 270 is inserted, an extension 245 extending upward from the body 244, and a plurality of coupling parts 246 extending downward from the body 244.

Each of the detecting units 230 may further comprise a roller shaft 252 coupled to the coupling parts 246, and a plurality of second rollers 250 through which the roller shaft 252 is inserted.

The second rollers 250 may be rotated with respect to the roller shaft 252. The second rollers 250 may make contact with the first roller 224. The medium (M) may pass through the second rollers 250 and the first rollers 224.

The detecting sensors 261, 262, and 263 comprise a light emitting part 261 disposed at a side of the extension 245, and a plurality of light receiving parts 262 and 263 disposed at the other side of the extension 245. That is, a part of the extension 245 is disposed between the light emitting part 261 and the light receiving parts 262 and 263. The light emitting part 261 and the light receiving parts 262 and 263 are spaced apart from the extension 245.

The light receiving parts 262 and 263 receive light emitted from the light emitting part 261 and output corresponding information. Then, a control unit (not shown) calculates the thickness of the medium (M) using the information output from the light receiving parts 262 and 263 and determine whether the medium (M) is genuine or counterfeit.

An end of the elastic member 280 is connected to the extension 245, and the other end of the elastic member 280 is connected to the frame 210. The elastic member 280 applies an elastic force to rotate the detecting lever 240 in a direction where the second rollers 250 make contact with the first roller 224. For example, the elastic member 280 pulls the extension 245 in the same direction as the moving direction (denoted by an arrow (A) in FIG. 3) of a medium (M). In another example, if the elastic member 280 is disposed at the right side of the extension 245, the elastic member 280 may push the extension 245 in the same direction as the moving direction of the medium (M). In another example, the end of the elastic member 280 may be connected to the coupling parts 246. As described above, the elastic member 280 applies an elastic force to the detecting lever 240 in the same direction as the moving direction of a medium (M).

The second rollers 250 are in contact with the first roller 224 before the medium (M) is transferred to the second rollers 250, and if the medium (M) is transferred between the second rollers 250 and the first roller 224, the detecting lever 240 is rotated by the medium (M).

Explanations will be given later of the operations of the detecting units 230 when the medium (M) is transferred, and how the thickness of the medium (M) is measured.

Figure 5:
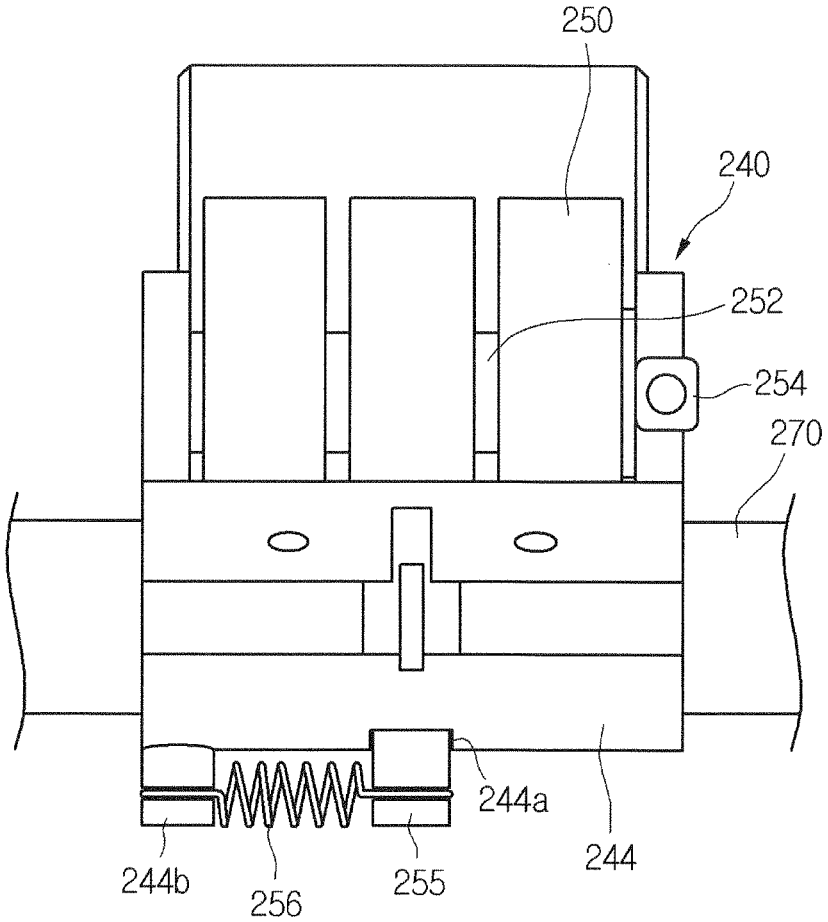
FIG. 5 is a plan view illustrating a state where a detecting unit is coupled to a lever shaft according to an embodiment.

FIG. 5 is a plan view illustrating a state where the detecting unit is coupled to the lever shaft according to an embodiment.

Referring to FIGS. 4 and 5, in a state where the lever shaft 270 is inserted through the body 244 of the detecting lever 240, a fixing pin 255 is coupled to the detecting lever 240 and the lever shaft 270 so as to inhibit the detecting lever 240 from moving in an extending direction of the lever shaft 270. A hole 244*a* is formed through the body 244 to receive the fixing pin 255. The hole 244*a* is longer in its vertical direction than in its transversal direction so that the fixing pin 255 may not interfere with the detecting lever 240 when the detecting lever 240 is rotated.

A protrusion 244*b* is disposed on the body 244. The protrusion 244*b* may be coupled to the body 244. The protrusion 244*b* is spaced apart from the fixing pin 255 which is inserted through the hole 244*a* and coupled to the lever shaft 270. An elastic member 256 is coupled to the fixing pin 255 and the protrusion 244*b*. The elastic member 256 may apply elastic forces to the fixing pin 255 and the protrusion 244*b* so that the fixing pin 255 and the protrusion 244*b* can approach or recede. Therefore, owing to the elastic member 256, the detecting lever 240 can be further inhibited from moving in the extending direction of the lever shaft 270.

If the detecting lever 240 is moved while the medium (M) is transferred, the amount of light incident on the light receiving parts 262 and 263 is varied, and thus the thickness of the medium (M) may not be exactly detected. However, according to the current embodiment, this may be inhibited since the detecting lever 240 is restrained from moving in the extending direction of the lever shaft 270. In the present disclosure, the fixing pin 255 may be referred to as a first movement restriction member, and the elastic member 256 may be referred to as a second movement restriction member.

Figure 6:
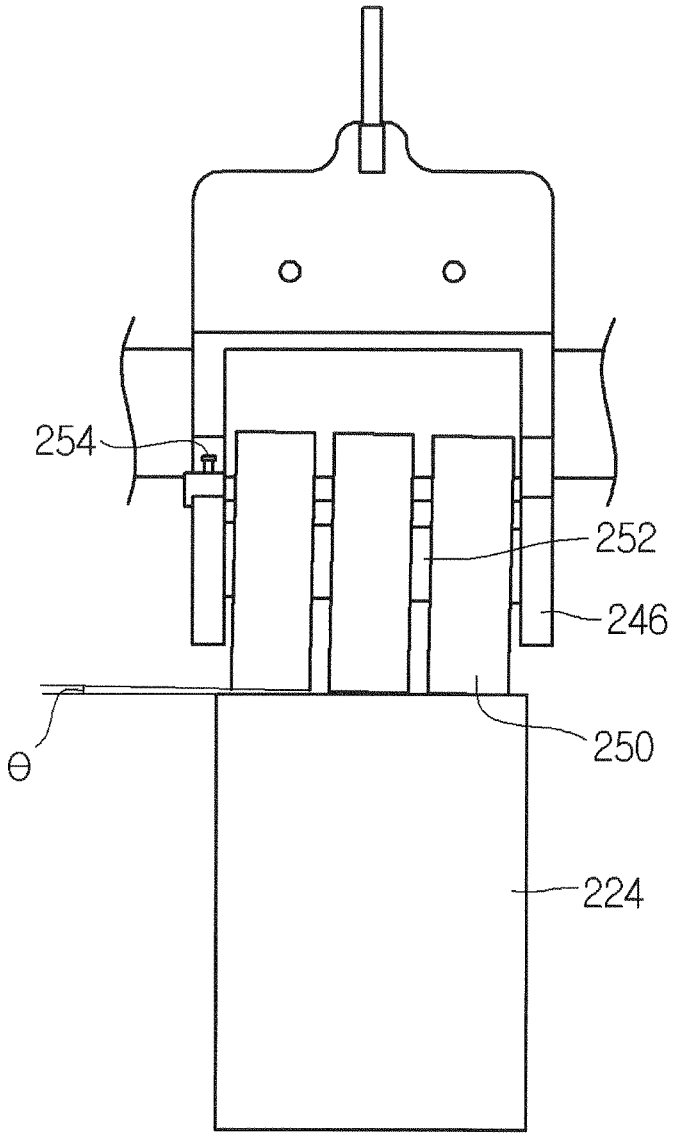
FIG. 6 is a view illustrating a state where some of second rollers are not yet brought into contact with a first roller in an assembling process of the detecting unit.
Figure 7:
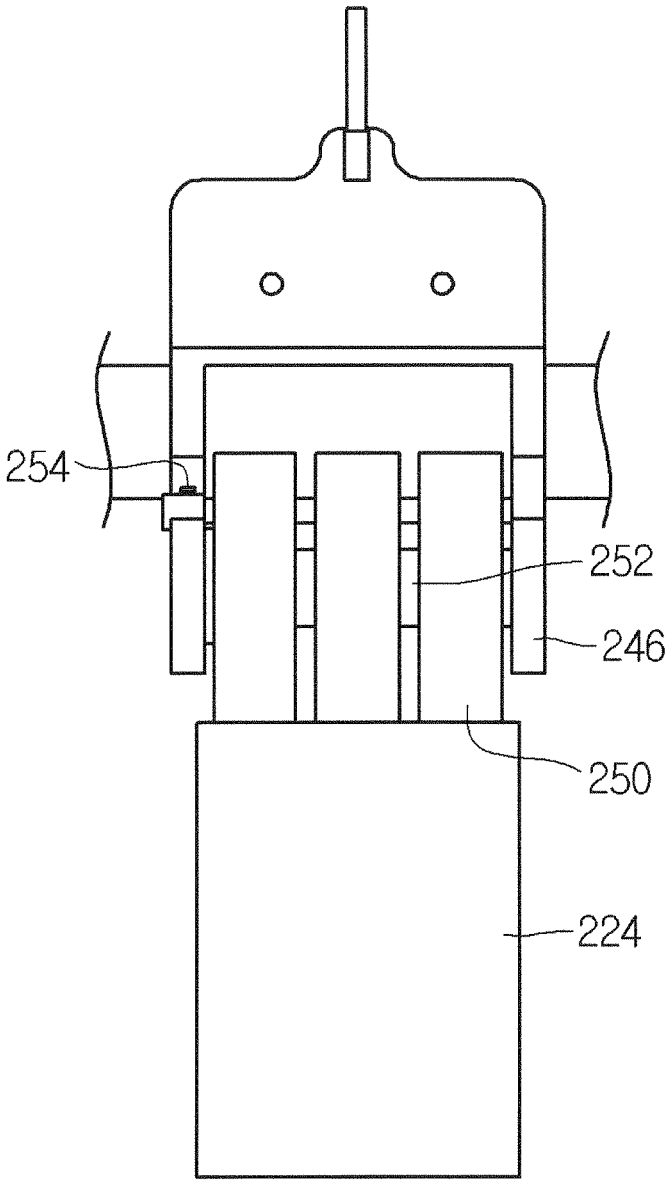
FIG. 7 is a view illustrating a state where the second rollers are in contact with the first roller.

FIG. 6 is a view illustrating a state where some of the second rollers are not yet brought into contact with the first roller in an assembling process of the detecting unit, and FIG. 7 is a view illustrating a state where the second rollers are in contact with the first roller.

Referring to FIGS. 6 and 7, an end of the roller shaft 252 is fixed to one of the coupling parts 246. The other end of the roller shaft 252 is movably coupled to the other of the coupling parts 246. That is, an end of the roller shaft 252 is a fixed end, and the other end of the roller shaft 252 is a free end.

An adjustment part 254 is disposed at the other of the coupling parts 246 to adjust the position of the other end of the roller shaft 252. For example, the adjustment part 254 may be a screw. The adjustment part 254 may make contact with the other end of the roller shaft 252. If the adjustment part 254 is rotated in the state shown in FIG. 6, the other end of the roller shaft 252 is pressed by the adjustment part 254. At this time, the adjustment part 254 presses the roller shaft 252 in a direction crossing the extending direction of the roller shaft 252. That is, a pressing force on the other end of the roller shaft 252 may be adjusted by tightening or loosening the adjustment part 254. In other words, all the second rollers 250 can be brought into contact with the first roller 224 by adjusting the rotation angle of the adjustment part 254.

If all the second rollers 250 are not brought into contact with the first roller 224, a measured thickness of the medium (M) may be smaller than the real thickness of the medium (M) because the rotation angle of the detecting lever 240 is smaller than expected. However, according to the embodiment, the position of the other end of the roller shaft 252 can be adjusted using the adjustment part 254 to bring all the second rollers 250 into contact with the first roller 224 and thus to reduce detection errors.

Hereinafter, operations of the detecting units 230 will be explained with reference to FIGS. 2 to 4.

Before the medium (M) is transferred, the amount of light incident on each of the light receiving parts 262 and 263 is constant. In the current embodiment, the light receiving parts 262 and 263 may receive the same amount of light or different amounts of light.

If the medium (M) starts to pass between the first roller 224 and the second rollers 250, the detecting lever 240 is rotated clockwise (when viewed in FIG. 3) on the lever shaft 270 by the medium (M).

Then, the (first) light receiving part 262 receives more amount of light, and the (second) light receiving part 263 receives less amount of light. The light receiving parts 262 and 263 output signals according to the amounts of light they receive, and the control unit determines the thickness of the medium (M) based on the signal containing information about light amount variations. Information about light amount variations of genuine media (M), and corresponding information about thicknesses of the genuine media (M) are stored in a memory (not shown). At this time, the light amount variation information and thickness information may be stored in the form of range information instead of value information. Since a plurality of media (M) can be transferred in a stacked state, a plurality of pieces of light amount variation information and a plurality of pieces of medium thickness information may be stored in the memory.

If a detected thickness of the medium (M) is within a predetermined range, the medium (M) is determined as being genuine, and if the detected thickness of the medium (M) is out of the predetermined range, the medium (M) is determined as being counterfeit.

As described above, according to the current embodiment, since the detecting units 230 are arranged at regular intervals, the thickness of the medium (M) may be detected over the entire region of the medium (M). Therefore, the entire thickness of the medium (M) can be precisely measured to improve the ability to determine whether the medium (M) is genuine or counterfeit can be determined.

In the current embodiment, the detecting units 230 detect the thickness of the medium (M) at surface positions of the medium (M) that makes contact with the second rollers 250 provided at each of the detecting levers. For example, in the case where the number of the detecting levers 240 is seven as shown in FIG. 2, the detecting units 230 can detect the thickness of the medium (M) at seven positions.

In other words, referring to FIG. 2, the medium (M) can be imaginarily divided into a plurality of uniform regions arranged in a transversal direction (perpendicular to the transfer direction of the medium (M)), and the detecting units 230 can detect the thicknesses of the respective regions of the medium (M). In this case, the number of the regions of the medium (M) may be at least three for precise detection of the thickness of the medium (M). In the example shown in FIG. 2, the thickness of seven regions of the medium (M) can be detected.

Even though all the elements of the embodiments are coupled into one or operated in the combined state, the present disclosure is not limited to such an embodiment. That is, all the elements may be selectively combined with each other without departing the scope of the invention. Furthermore, when it is described that one comprises (or includes or has) some elements, it should be understood that it may comprise (or include or has) only those elements, or it may comprise (or include or have) other elements as well as those elements if there is no specific limitation. Unless otherwise specifically defined herein, all terms comprising technical or scientific terms are to be given meanings understood by those skilled in the art. Like terms defined in dictionaries, generally used terms needs to be construed as meaning used in technical contexts and are not construed as ideal or excessively formal meanings unless otherwise clearly defined herein.

Although embodiments have been described with reference to a number of illustrative embodiments thereof, it will be understood by those skilled in the art that various changes in form and details may be made therein without departing from the spirit and scope of the invention as defined by the appended claims. Therefore, the preferred embodiments should be considered in descriptive sense only and not for purposes of limitation, and also the technical scope of the invention is not limited to the embodiments. Furthermore, is defined not by the detailed description of the invention but by the appended claims, and all differences within the scope will be construed as being comprised in the present disclosure.

What is claimed is:

1. A medium process apparatus comprising:

a support device configured to support a medium that is being transferred; and a plurality of detecting units configured to detect a state of the medium, wherein the detecting units are arranged at regular intervals, and each of the plurality of detecting units comprises a detecting lever and a detecting sensor configured to output a signal according to a movement of the detecting lever, wherein if the medium is divided into uniform regions arranged in a direction perpendicular to a transfer direction of the medium, the detecting units detect states of corresponding regions of the medium, and wherein each of the plurality of detecting units further comprises:

a plurality of rollers;

a roller shaft configured to support the plurality of rollers; and an adjustment part configured to adjust a position of the roller shaft, wherein the adjustment part presses the roller shaft in a direction crossing an extending direction of the roller shaft.

2. The medium process apparatus of claim 1, wherein the plurality of detecting units comprise a first detecting unit, a second detecting unit, and at least one third detecting units between the first and second detecting units.

3. The medium process apparatus of claim 1, further comprising a lever shaft inserted through the detecting levers of the plurality of detecting units.

4. The medium process apparatus of claim 3, further comprising first movement restriction members coupled to the detecting levers and the lever shaft so as to inhibit the detecting levers from moving in an extending direction of the lever shaft.

5. The medium process apparatus of claim 4, further comprising second movement restriction members configured to apply elastic forces to the detecting levers so as to inhibit the detecting levers from moving in the extending direction of the lever shaft.

6. The medium process apparatus of claim 5, wherein the detecting levers comprise protrusions, respectively, and the second movement restriction members are connected between the protrusions and the first movement restriction members, respectively.

7. The medium process apparatus of claim 1, wherein the adjustment part is rotatable, and a pressing force applied from the adjustment part to the roller shaft is varied according to a rotation amount of the adjustment part.

8. The medium process apparatus of claim 1, wherein the support device comprises a plurality of first rollers and a roller shaft by which the plurality of first rollers are rotatably supported, wherein the number of the detecting units is equal to the number of the plurality of first rollers.

9. The medium process apparatus of claim 8, wherein each of the plurality of detecting units further comprises a plurality of second rollers contactable with the plurality of first rollers.

10. A medium process apparatus comprising:

a support device comprising a plurality of rollers to support a medium that is being transferred; and a plurality of detecting units configured to detect a state of the medium, wherein the number of the plurality of detecting units is equal to the number of the plurality of the rollers, the plurality of detecting units are arranged at regular intervals, and the plurality of detecting units comprise detecting levers, detecting sensors configured to output signals according to movements of the detecting levers, and a lever shaft inserted through the detecting levers;

a fixing pin coupled to at least one of the detecting levers and the lever shaft so as to prevent the at least one of the detecting levers from moving in an extending direction of the lever shaft; and an elastic member connected to the fixing pin to apply elastic forces to the at least one of the detecting levers so as to prevent the at least one of the detecting levers from moving in the direction of the lever shaft.

11. The medium process apparatus of claim 10, wherein the fixing pin is coupled to the lever shaft after passing through the at least one of the detecting levers.

12. The medium process apparatus of claim 10, wherein each of the plurality of detecting units comprises:

a plurality of rollers;

a roller shaft configured to support the plurality of rollers; and an adjustment part configured to adjust a position of the roller shaft.

13. The medium process apparatus of claim 12, wherein the adjustment part presses the roller shaft in a direction crossing an extending direction of the roller shaft.

* * * * *